US008083654B1

(12) United States Patent
MacDonald et al.

(10) Patent No.: US 8,083,654 B1
(45) Date of Patent: Dec. 27, 2011

(54) APPARATUS FOR REHABILITATION

(76) Inventors: Louis R. MacDonald, Bayport, NY (US); Shawn McNamara, Selden, NY (US)

( * ) Notice: Subject to any disclaimer, the term of this patent is extended or adjusted under 35 U.S.C. 154(b) by 22 days.

(21) Appl. No.: 12/378,324

(22) Filed: Feb. 17, 2009

(51) Int. Cl.
*A63B 21/00* (2006.01)

(52) U.S. Cl. ..... 482/121; 482/79; 482/80

(58) Field of Classification Search ..... 482/124, 482/121, 79, 80, 49, 129, 904
See application file for complete search history.

(56) References Cited

U.S. PATENT DOCUMENTS 4,605,220 A 8/1986 Troxel
4,733,859 A * 3/1988 Kock et al. ..... 482/79
4,913,423 A * 4/1990 Farran et al. ..... 482/130
5,016,874 A 5/1991 Boardman
5,100,129 A 3/1992 Porter et al.
5,186,698 A 2/1993 Mason et al.
6,045,486 A * 4/2000 Jensen ..... 482/27
6,063,013 A 5/2000 Vathappallil
6,277,057 B1 8/2001 Hayden
6,390,957 B1 5/2002 Knight
6,540,651 B1 4/2003 Aberton et al.
6,554,747 B1 4/2003 Rempe
6,821,235 B1 11/2004 Johnson et al.
6,942,487 B2 9/2005 Corbalis
7,214,171 B2 5/2007 Thelen et al.

* cited by examiner

*Primary Examiner* — Jerome W Donnelly
(74) *Attorney, Agent, or Firm* — Robert R. Strack

(57) ABSTRACT

A method and apparatus for exercising and rehabilitating muscles, muscle groups, ligaments and soft tissue connecting limbs and limb extremities wherein the limb extremity is suspended by tension means in an environment that stabilizes the limb position while facilitating the movement of the extremity in space. The apparatus includes tension members to develop and provide desired counter forces in opposition to those created by strain of the selected muscles, muscle groups, ligaments and soft tissue.

10 Claims, 1 Drawing Sheet

APPARATUS FOR REHABILITATION

BACKGROUND OF THE INVENTION

1. Field of the Invention

The invention relates to rehabilitative exercise, and more particularly to methods and equipment designed to permit an athlete or patient to exercise selected parts of the body under controlled conditions within a prescribed range.

Accidents, athletic injuries, and aging often result in weakness or deterioration of muscles, muscle groups, ligaments and other soft tissue structures impairing the operation of limbs, body parts, and their related extremities. It is well appreciated that muscle impairment can often be reduced or eliminated by appropriate exercise and physical therapy. Athletes and healthy individuals also have the need to strengthen and condition healthy muscles and forestall weakening or injury.

Many exercise procedures and devices have been devised to strengthen, condition and rehabilitate targeted muscles and muscle groups. The effectiveness of these procedures and devices often depends upon frequency, ease of use, and adherence to correct procedures. While the attendance and participation of a trainer, physical therapist or other health care professional is undoubtedly preferred; availability, cost and scheduling frequently dictate that such procedures be performed in private by the athlete or patient.

There are a variety of ways to exercise. The exercise may be isotonic, wherein a muscle shortens against a constant load; it may be isometric involving muscular contraction without movement of the involved parts of the body; or it may be isokinetic and performed with specialized apparatus that provides variable resistance to movement, so that no matter how much effort is exerted the movement takes place at a constant speed.

A muscle's response to the exercise may be concentric contraction, wherein force is generated by muscle contraction sufficient to overcome external resistance and the muscle shortens as it contracts; or it may be eccentric contraction, wherein the force generated by muscle contraction is insufficient to overcome the external resistance placed on the muscle and the muscle fibers lengthen as the muscle contracts.

2. Description of Related Art

Numerous devices have been developed to exercise the foot, ankle and lower leg. For example: U.S. Pat. No. 5,100,129 to Porter and Spence; U.S. Pat. No. 5,186,658 to Masson and Masson; U.S. Pat. No. 6,390,957 to Knight; and U.S. Pat. No. 6,540,651 to Aberton et al, each employ elastic tensioning devices for connecting a foot to a rigid structure. U.S. Pat. No. 4,605,220 to Troxel; U.S. Pat. No. 6,063,013 to Vathappallil; U.S. Pat. No. 6,277,057 to Hayden; and U.S. Pat. No. 6,821,235 to Johnson and Johnson describe foot engaging devices including springs or shock absorbers to control movement of a foot within a prescribed range and with controlled pressure.

The value and versatility of elastic connecting members, is demonstrated by the disclosures of U.S. Pat. No. 5,016,874 to Boardman, U.S. Pat. No. 6,942,487 to Corbalis; U.S. Pat. No. 6,554,747 to Rempe; and U.S. Pat. No. 7,214,171 to Thelen and Thelen. Boardman shows a bar connected by four elastic members to the corners of a portable square planar frame. Corbalis uses a spring board suspended by flexible straps within a frame to teach skate board tricks. Rempe discloses a housing within which a person can be suspended while performing functional tasks and exercises. Thelen et. al. suggests the use of a bungee-type cord to train figure skaters.

The use of elastic tensioning for wrist and hand exercising is disclosed in U.S. Pat. No. 6,099,438 to Dawson, wherein springs support a hand grip within various plastic tubing structures.

To a greater or lesser extent, exercise techniques and devices, act to encourage or restrain the motion of the joints being exercised. The "motion of the joints" may be described as the motion of the limb extremity distal to the joint. The joints themselves, under the restraints and control of their structure and related muscles and ligaments, permit or constrain movement of the limb extremity within the three cardinal body planes: the sagittal plane being the median plane of the body (or any plane parallel thereto), the transverse plane being transverse to the anterior-posterior axis of the body, and the frontal plane being parallel to the main axis of the body and at right angles to the sagittal plane.

Motion occurs in the three cardinal body planes, but is defined by the anatomical position of the limb extremity relative to the limb or body as a whole which does not always correspond to the cardinal planes. For example, motion of the ankle/subtalar joint complex—addressed in the preferred embodiment hereinafter described—in the sagittal plane is plantar flexion or dorsiflexion, in the transverse plane is abduction or adduction, and in the frontal plane is inversion or eversion.

The direction of motion of a limb extremity around a joint, constitutes or describes an "axis of motion". Motion about the joint often involves more than one type of motion and the axis of motion does not fall entirely within one cardinal body plane. It will be appreciated that the axis of motion of a joint is not the same for every individual, but is determined by bone structure, joint structure and ligamentous stability. Indeed, often the axis of motion is not a static axis, but a variable axis that changes both position and angulation as the joint is moved through its range of motion.

To date, no satisfactory method or equipment has been developed for unmonitored use that can be adapted to exercise or rehabilitate the muscles, muscle groups, tendons, and ligaments connecting joints, such as ankles or wrists, by constraining exertion of limb extremities against resistance applied within a prescribed three-dimensioned range of motion specifically tailored to the joint and its structure.

SUMMARY OF THE INVENTION

In describing the preferred embodiment of the invention, reference will be made to "limb extremities" (such as hands and feet) which are connected via "joints" to "limbs" (such as arms and legs). The limb extremities have distal portions remote from the limbs, and proximal portions close to the limbs. While describing an embodiment for exercising the subtalar and ankle joint complex, it should be appreciated that the unique method and apparatus described may be modified to effectively exercise other body parts.

An object of the invention is to provide a method for exercising and rehabilitating muscles, muscle groups and ligaments associated with limb extremities.

Another object of the invention is to provide apparatus for exercising and rehabilitating muscles, muscle groups and ligaments associated with limb extremities.

Another object of the invention is to create a three dimensional rehabilitative environment for exercising body joints, wherein straining muscles are resisted with controlled pressure.

It is a further object of the invention to provide a rehabilitation device for body joints that can be operated without supervision or assistance.

Still another object of the invention is to provide a rehabilitation device that can be adjusted and adapted to the size and specific physical needs of the individual user.

Yet another object of the invention is to provide a rehabilitation device that requires little or no instruction to achieve appropriate results.

The invention features the method of exercising a limb extremity wherein the limb is maintained stable, the limb extremity is quiescently supported in a non-stress position, and during exercise, movement of the limb extremity is opposed in all three dimensions with selective resistance in reaction to the muscular forces used as the extremity is strained.

The invention also features equipment for exercising the muscles, muscle groups and ligaments connecting limbs and limb extremities, wherein means are provided to apply resistance to the limb extremity in any and all directions responsive to muscle strain in such directions.

In the particular embodiment described herein, an open rigid frame defines a three dimensional space within which a limb is statically positioned with the limb extremity quiescently supported in a non-stress condition. The limb extremity is fastened to a support element that is suspended by tension elements which apply a directed force in opposition to the muscular force used as the extremity is strained to move.

The method and apparatus of the invention will be understood and appreciated further from the following description in connection with the drawings. Of course, those skilled in the art will recognize modifications and substitutions of steps and components effective to achieve particular objectives. Such changes are intended to be covered within the scope and definition of the appended claims.

DETAILED DESCRIPTION OF A PREFERRED EMBODIMENT

The illustrated embodiment is specifically configured to exercise and rehabilitate the muscles of the ankle and subtalar joints. It will be understood by those skilled in the art that the unique features of the invention may be used to exercise and rehabilitate other body muscles and joints. Using known skills appropriate apparatus will be specifically modified to accommodate the particular muscles or joints being targeted.

The ankle joint and subtalar joint work together to provide complex motions of the foot in all three body planes.

The ankle joint lies approximately 8° from the transverse plane and 20°-30° from the frontal plane. Because of this structure and positioning, motion about the ankle is predominantly in the sagittal plane with slight transverse plane motion. The ankle joint dorsiflexes with slight abduction and plantar flexes with slight adduction in open kinetic chain, i.e. with the foot not on the ground.

Open kinetic chain motion of the subtalar joint is tri-planar. The subtalar joint axis lies about 42° from the transverse plane and 16° from the sagittal plane. There is known to be large variations in the subtalar joint axis from the frontal plane. Motion of the subtalar joint predominantly occurs in the transverse and frontal planes with almost equal motion in each plane. Thus, iversion occurs with adduction and eversion occurs with abduction. The deviation from the sagittal plane does add some dorisflexion and planar flexion.

The purpose of this invention is to accommodate the normal motion effected by muscle strain in the diverse multi-directional range imposed by the dictates of the joint structure of the body part being exercised.

It is recognized that rehabilitation can be effected by movement using the muscles and muscle groups of a limb or limb extremity under controlled pressure. The invention provides a method for such rehabilitation wherein the pressure is commensurate with the movement, direction of movement, range of motion, and strain imposed by the muscles or muscle groups.

Thus, this unique method for exercise and rehabilitation of limb muscles and muscle groups involves supporting the limb in a substantially immovable position, supporting the limb extremity in a three dimensional environment, and applying multi-directional counter force to the limb extremity in opposition to the forces generated by the strain of the muscles and muscle groups.

This may be accomplished by applying the resistance or counter force directly to the limb extremity, or by firmly securing the limb extremity to a support that is in turn subjected to resistance in force and direction that is directed counter to that generated by the strain of the muscles and muscle groups.

The method of the invention may be practiced by a skilled physical therapist, trainer or other health care practitioner and it can be carried out by athletes and patients through the use of apparatus embodying the present invention.

Figure 1:
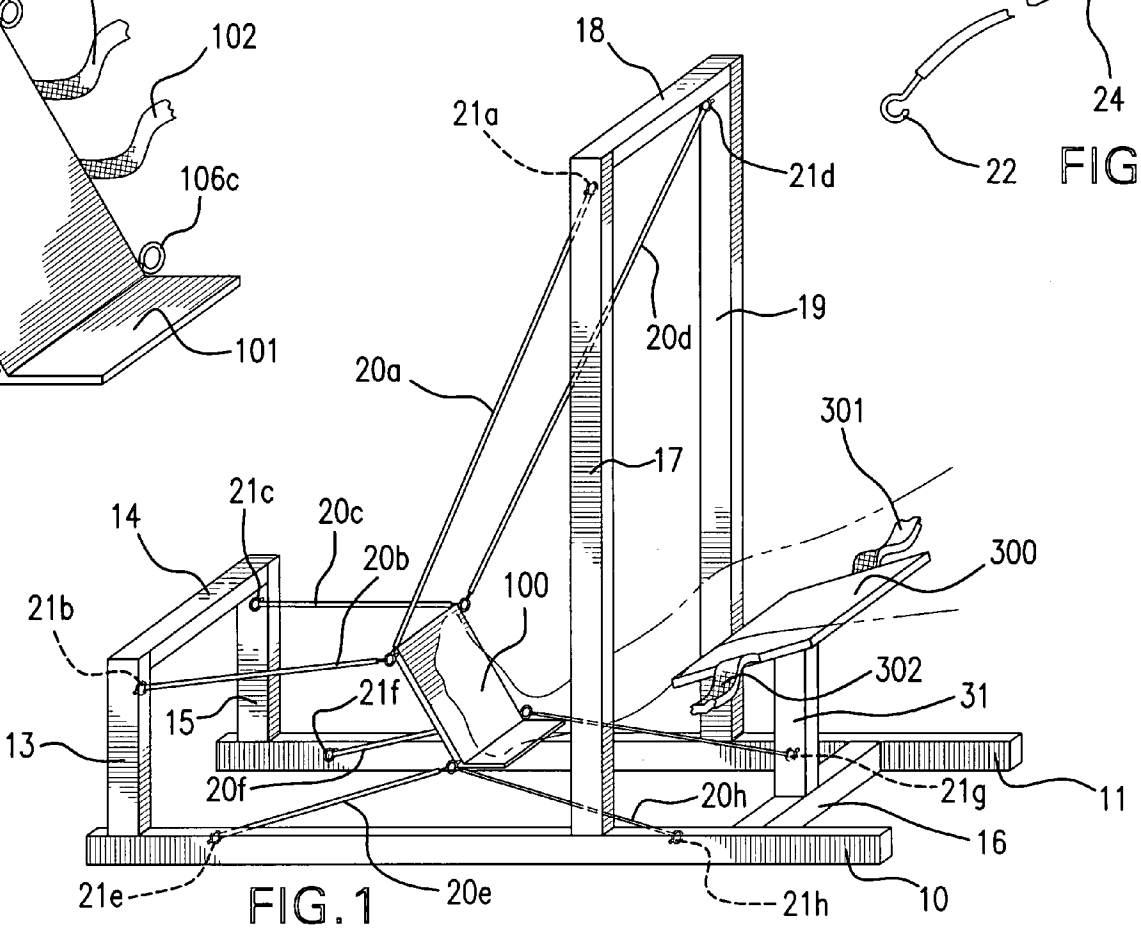
FIG. 1 is a perspective illustration of a particular embodiment of apparatus utilizing the features of the invention.

The embodiment of FIG. 1, illustrates apparatus specifically designed to exercise the ankle and subtalar joints. In use, the patient will be seated to the right of the apparatus shown in the figure.

The base of the apparatus comprises separated base struts 10 and 11. Base struts 10, 11 are held rigidly apart at the distal end by bridging unit 13, 14, 15; and at the proximal end by cross bar 16. An upright rigid bridge unit 17, 18, 19 is disposed between the bridge 13, 14, 15 and cross bar 16.

A limb support pad 300 is pivotally mounted at the top of a rigid vertical post 31, to support the patient's limb—illustrated in phantom. Pad 300 may advantageously include fastening means 301, 302 to secure the limb. Pad 300 is coupled to vertical post 31 so that pad 300 is adjustable in height to accommodate the comfort of a patient seated to the right of the apparatus. The coupling between pad 300 and post 31 pivots to adjust the position of the limb relative to the location of an extremity support element 100.

Extremity support element 100 is suspended by tension elements **20*a*-20*h*. Connection points 21*a*-21*h* are provided at and along the frame of the apparatus. As shown, tension elements 20*a*-20*h* are connected between extremity support element 100 and points 21*a*-21*h*, respectively. The resilience of tension elements 20*a*-20*h* is selected in accordance with the range of motion anticipated and the amount of stress desired. Connection points 21*a*-21*h* may be located at different positions along the struts and bridging units to control tension and establish satisfactory positioning of extremity support element 100** in a quiescent location to support a patient's foot in the sagittal plane at an angle between 60° and 150° substantially corresponding to the at-rest position of the foot.

Extremity support element 100 is positioned within the space defined by the apparatus. In use, a patient is seated in front of the apparatus (i.e. to the right as illustrated in FIG. 1) placing his limb on support 300 projecting into the apparatus.

The method of the invention seeks to maintain the limb basically stable and consequently, fastening means 301, 302 may be provided to prevent longitudinal movement of the limb into or out of the apparatus. When the ankle and subtalar joints are to be exercised, the patient's foot is placed upon and secured to pad 100.

While FIG. 1 shows connection points 21*e*-21*h* on base struts 10, 11; connection points 21*b*, 21*c*, on bridge unit 13, 14, 15; and connection points 21*a*, 21*d* on bridge units 17, 18, 19, These points may be altered to optimally position pad 100 to effect the desired suspension and three-dimensioned resistant response, in degree and range, to movement of the foot during exercise as the muscles and muscle groups are strained to move the foot.

Figure 2:
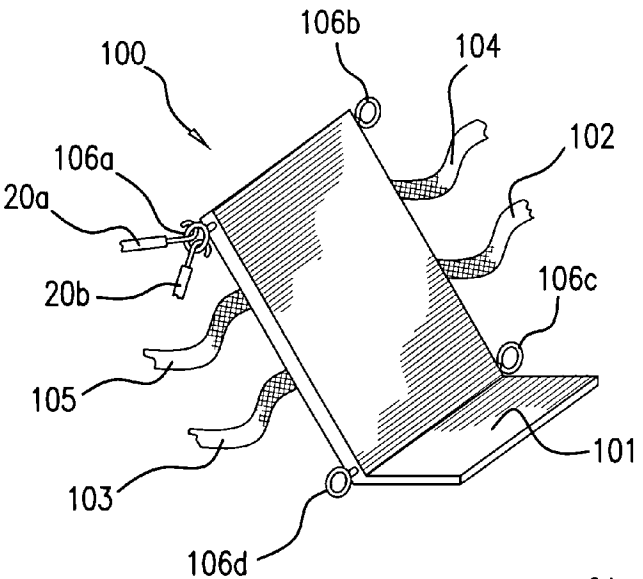
FIG. 2 is a schematic illustration of an extremity support pad showing the attachment of suitable tension elements.

FIG. 2 illustrates a foot support pad 100 having a heel support 101. Straps 102, 103 are provided to secure the patient's heel and ankle. Straps 104, 105 are provided to secure the patient's forefoot. The straps may be fastened by Velcro™, buckles, or any other convenient means to effectively hold the patient's foot to pad 100 so that movement of the foot is directly reflected in movement of the pad and so that the resistance to such movement—created by connected tension elements—is directly reflected in resistance to the muscle strain that effects such movement. Pad 100 may be flat or contoured and of a size to match the patient's foot.

At points about the periphery of pad 100, connection means 106*a*-106*d* are provided. These may be simple loops or hooks adapted to receive mating connection means on tension elements 20*a*-20*h*.

FIG. 2 shows the typical connection of two elongated tension elements 20*a* and 20*b* to connection means 106*a* at the upper left edge of foot support pad 100. It is important that the connections remain secure throughout any exercise procedure. It is preferable that the connections can be easily established and undone, and they should preferably be of a universal nature so that various tension elements may be substituted depending upon the strain anticipated during exercise.

Figure 3:
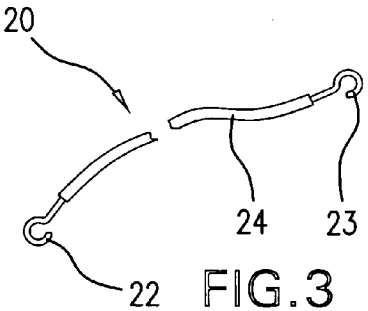
FIG. 3 is an illustration of a suitable tension element for connecting the extremity support pad to the apparatus frame.

FIG. 3 illustrates a typical tension element 20, having connection means such as hooks 22, 23 at each end. Thera-Band™ tubing 24 having the appropriate force/strain ratio may be used as the tension elements. The length of the tubing is chosen to provide a satisfactory resistance and range of motion within the mounting apparatus.

Thera-Band™ tubing is currently used in various exercise and rehabilitative regimens and programs. A technical report by Patterson, Stegink Jansen, Hogan and Nassif in "Physical Therapy", Volume 81, Number 8, August 2001 quantifies the material properties of such tubing, reporting that the material is compliant and displays non-linear behavior in the initial stretching phase and linear behavior after 50% elongation. This tubing is used to provide resistance for exercise and to increase range of motion after trauma.

Having described a specific apparatus for exercising the ankle/subtalar joint complex, it is appropriate to recognize the inventive exercise method that is being practiced.

The efficacy of this method is not limited to rehabilitation of ankle/subtalar joints. It lies in recognition that that the limb extremities are connected by muscles, muscle groups, ligaments and other soft tissue structures that yield a particular potential range of motion dictated by the structure of the joint and its component parts. The potential range, resistance and direction of motion is universal and therefore must be countered in varying degrees within a three dimensional environment that is responsive to the particular capabilities of the joint being treated.

In order to maximize the recuperation and/or strengthening of the muscles, muscle groups, ligaments and other soft tissue structures envisioned by this invention, it is necessary to permit and encourage full motion of the limb extremity supported at the joint or joints involved. At the same time, it is necessary to position and maintain the limb in a substantially fixed relationship to the extremity and connecting joint(s).

This invention teaches the method of rehabilitating the joints connecting limb extremities to limbs. The method includes, engaging the limb, independently supporting the limb extremity, and applying universally directed resistance to the limb extremity in reaction to movement of the extremity by muscle strain, wherein the level, range, and direction of the resistance is commensurate with the strain, range and movement dictated by the particular joint.

In accordance with the invention, controlled movement of the limb extremity in any direction is opposed; this opposition being of a force and direction needed to be overcome by muscle strain in order for the controlled movement to have occurred.

It will be appreciated that the method and apparatus of the invention can be used with a minimum of instruction to yield a maximum of controlled exercise. Operation of the apparatus is intuitive and automatic. Having selected the appropriate tension elements, the patient simply inserts his limb extremity into the apparatus, rests his limb upon a support and secures his limb extremity to a suspended pad. Thereafter, as the patient's muscles are strained to move, the apparatus automatically opposes each movement commensurate with the strain in accordance with the force and direction of the strain.

While the apparatus described has shown a foot support pad and described the use of the invention for exercising the subtalar and ankle joint complex, it should be understood that this method and apparatus may also be suitably used for exercising wrists and other body parts connected by joints, muscles, muscle groups, and ligaments; it merely being necessary to make appropriate adjustments to size, force/strain ratios, and support components.

Specific exercising methods and certain apparatus have been described to illustrate the unique features of the invention. It is appreciated and expected that those skilled in the arts involved will recognize modifications that may be made to obtain related results. All such modifications are intended to be covered to the extent embraced by the following Claims.

What is claimed is:

1. Rehabilitative apparatus for exercising the muscles, muscles groups, ligaments and soft tissue connecting a limb and limb extremity, comprising a) stable support means for said limb, b) a rigid frame having connection points, c) mobile support means for said limb extremity suspended within said frame, d) said mobile support means having upper and lower edges, e) multiple tension means connected between said connection points and said mobile support means establishing the quiescent position of said mobile support means and permitting universal movement thereof in any direction, f) said connection points lying above and below said mobile support means in at least two planes, g) said upper edges of said mobile support means being connected by said tension means to connecting points in a first plane, and h) said lower edges of said mobile support means being connected by said tension means to connecting points in a second plane, i) said tension means being positioned to produce counter force on said mobile support means having a magnitude and direction opposing the force and direction applied by said limb extremity to said mobile support means.

2. Rehabilitative apparatus as defined in claim 1, a) said upper edges of said mobile support means being further connected by said tension means to connecting points in a third plane, and b) said lower edges of said mobile support means being further connected by said tension means to connecting points in a fourth plane.

3. Rehabilitative apparatus as defined in claim 1 wherein said tension means are adjustable to provide selected force/strain ratios.

4. Rehabilitative apparatus as defined in claim 1 wherein said limb extremity is securely fastened to said mobile support means and is free to move therewith in any direction dictated by the muscles, muscles groups, ligaments and soft tissue connecting said limb and said limb extremity.

5. Rehabilitative apparatus as defined in claim 1, wherein movement of said mobile support means is responsive to contraction or expansion of said muscles and muscle groups, and said tension means exert opposing force to said mobile support means determined by the range and direction of said movement.

6. Rehabilitative apparatus as defined in claim 5, wherein the quiescent position of said mobile support means and the position of said stable means correspond with the functional neutral position of said limb and limb extremity.

7. Rehabilitative apparatus as defined in claim 5, wherein the quiescent position of said mobile support means and the position of said stable means are within the anatomical range of motion between said limb and said limb extremity.

8. Rehabilitative apparatus as defined in claim 1, wherein the quiescent position of said mobile support means and the position of said stable support means correspond with the functional neutral position of said limb and said limb extremity.

9. Rehabilitative apparatus as defined in claim 1, wherein the quiescent position of said mobile support means and the position of said stable means are within the anatomical range of motion between said limb and said limb extremity.

10. Rehabilitative apparatus as defined in claim 1 wherein a) said tension means are elongated elements with connection means at each end, b) the connection means at one end of each said elongated elements being connected to said connection points and the connection means at the other end of each said elongated elements being connected to said mobile support means.

* * * * *